US005222767A

United States Patent [19]

Volkema

[11] Patent Number: 5,222,767

[45] Date of Patent: Jun. 29, 1993

[54] DOUBLE USE MANUSCRIPT DIVIDER

[76] Inventor: Russell H. Volkema, 250 S. Ocean Blvd., Apt. 3-G, Boca Raton, Fla. 33432

[21] Appl. No.: 922,634

[22] Filed: Jul. 30, 1992

Related U.S. Application Data

[63] Continuation of Ser. No. 740,087, Sep. 30, 1991.

[51] Int. Cl.[5] ..... B42F 21/00

[52] U.S. Cl. ..... 283/37; 402/79

[58] Field of Search ..... 283/36, 37, 38, 41, 283/42, 43, 61; 402/79

[56] References Cited

U.S. PATENT DOCUMENTS 1,300,662 4/1919 Showalter ..... 283/36

3,938,268 2/1976 Gilhula ..... 283/36 X 4,544,182 10/1985 Spring ..... 283/37 X 4,978,143 12/1990 Ericson ..... 283/36 X

*Primary Examiner*—Mark Rosenbaum

*Assistant Examiner*—Willmon Fridie, Jr.

*Attorney, Agent, or Firm*—Price, Heneveld, Cooper, DeWitt & Litton

[57] ABSTRACT

A divider system for a manuscript in which a plurality of divider sheets are provided with tabs extending from one edge of each sheet. The tabs on the top side are marked with progressively higher indicia from the first to last sheet and the back side of the tabs are marked with progressively higher indicia from the last to the first sheet, the indicia on the back side being rotated 180° with respect to the indicia on the top side.

4 Claims, 2 Drawing Sheets

DOUBLE USE MANUSCRIPT DIVIDER

This application is a continuation of my application Ser. No. 07/740,087, filed Sep. 30, 1991, and entitled "Double Use Notebook Divider".

This invention relates to a divider system and a divider for use in dividing indexing a manuscript such as a notebook, a brief or other similar types of manuscripts.

BACKGROUND OF THE INVENTION

Dividers for notebooks, briefs, and the like are prevalently used. However, the dividers are frequently not fully used resulting in disposal of the same and the waste of tons and tons of paper. The present invention, by a simple change in the tabs, allows almost full use of dividers with resultant savings in paper which otherwise would be disposed of or not used.

SUMMARY OF THE INVENTION

The present invention utilizes conventional dividers having tabs extending from one edge thereof. The tabs have marked on one side indicia which can be letters or numbers, each tab from the first to the last divider being progressively marked from lowest to the highest number or the lowest to the highest letter. For example, the first divider will have its tab marked as 1 or A, the second as 2 or B, the third as 3 or C, etc.

In accordance with this invention, the back side of each tab is numbered or lettered progressively downward. For example, the back of the first divider will be marked 26 or Z, the back of the second divider will be marked 25 or Y, the back of the third divider tab is marked 24 or X, etc. Further, the indicia on the back side of the tab will be rotated 180° with respect to the indicia on the front side.

With the above arrangement, the divider can be turned upside down with the edge containing the tab oriented in the same position as originally used and therefore, the divider can be reused. Further, in a series of dividers marked 1–26 or A–B, those dividers not used in series, such as 14–26 or M–Z can be used by turning the dividers upside down as 1–13 or A–L, respectively. Thus, the present invention results in the full usage of the dividers and the savings in the quantum of paper.

Figure 1:
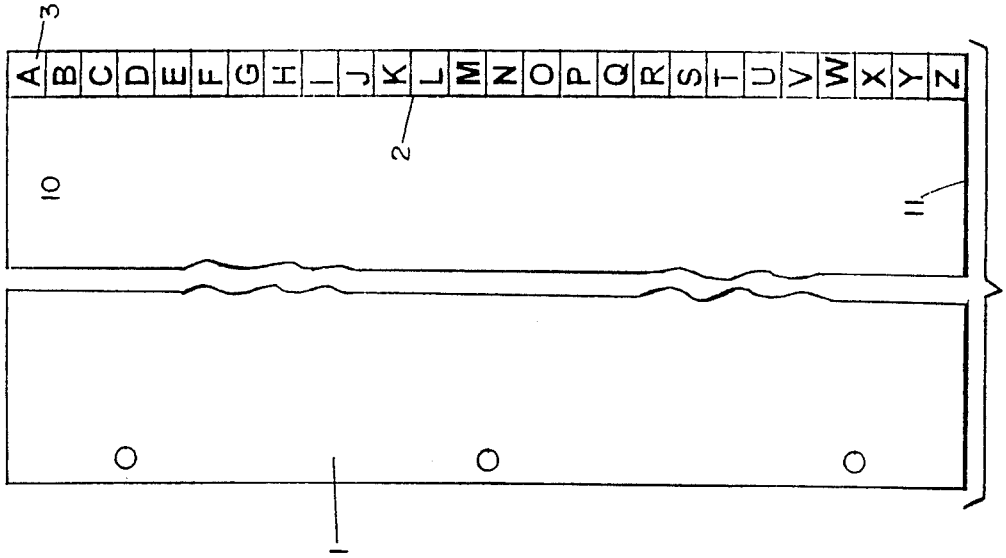
FIG. 1 shows, in a plan view, a series of dividers, each having a tab with a progressively higher indicia.
Figure 7:
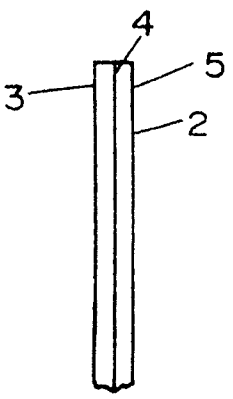
FIG. 7 is a cross-sectional view of the dividers taken along the plane VII—VII of FIG. 2.

Referring to the drawings, FIG. 1 discloses a series of dividers including the first divider 1 having an edge 2 from which extends the tab 3 which is marked with the letter A. The divider sheet 1 is superimposed over 25 different sheets, each of them having a tab extending from their sides 2 and marked progressively with the letters B, C, D, E. . . X, Y, Z. This series of dividers have use in dividing and indexing manuscripts such as a notebook, a brief, a book or any other type of manuscript, it being understood that manuscript means any compilation of writings or data that requires dividers so as to index the materials within the manuscript. So far, as disclosed by FIG. 1, the dividers of this type are well known and have been used extensively for a number of years for indexing any number of manuscripts. One problem is that the dividers are generally sold in series with their tabs marked from A to Z or from 1 to any higher number. Therefore, if only a few of the dividers are utilized for any one manuscript, the other dividers have very little utility since the indexing is done generally starting with A or 1. Further, when a manuscript is to be disposed of, the dividers are generally also disposed of because of the tab or face of the divider are written or otherwise the indicia is mutilated.

Figure 3:
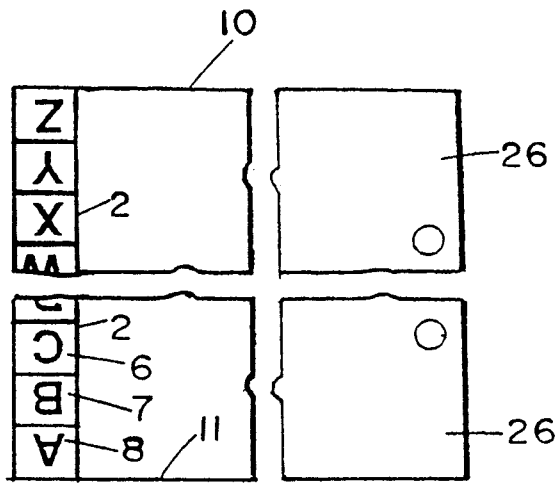
FIG. 3 is a plan view of the back side of the dividers of FIG. 2 in which the edge of the dividers containing the tabs are located on the left side to illustrate the indicia on the back side of the tabs are rotated 180° with respect to the indicia on the front side as disclosed in FIG. 2.
Figure 2:
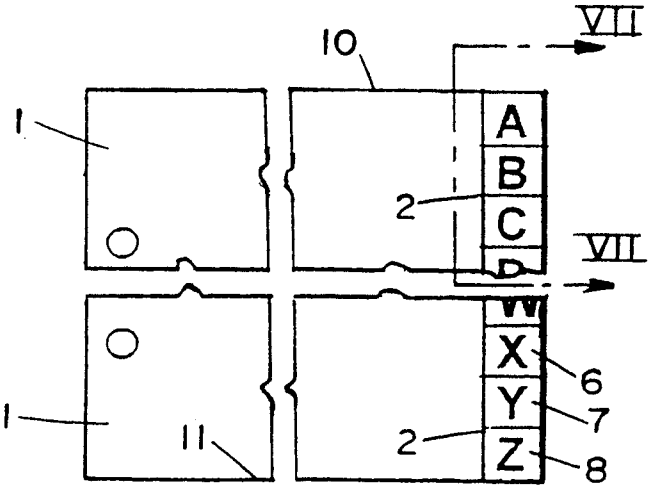
FIG. 2 is a partial plan view of the dividers of FIG. 1.

In accordance with this invention, as illustrated by FIGS. 2–6, the tabs are marked on both sides. FIG. 2 discloses the same series of dividers as FIG. 1 with the divider 1 on top and the edges 2 of the dividers located on the right. FIG. 3 discloses the same series of dividers with the lowermost divider 26 on top and the edges 2 of the dividers located at the left. It will be noted that tab 3 is marked on its front side with the letter "A'8 whereas the same tab 3 is marked on its back side with the letter "Z" rotated 180° with respect to the letter "A" on the front side. This is true of the tabs 4, 5, 6, 7, and 8 (FIGS. 2 and 3) which are marked, respectively, "B," "C," "X," "Y," and "Z" whereas the back sides of tabs 3, 4, 5, 6, 7, and 8 are marked respectively with the letters "Z," "Y," "X," "C," "B" and "A." Further, the letters Z, Y, X, C, B, and A (FIG. 3) are rotated 180° with respect to the letters A, B, C, X, Y, and Z (FIG. 2), respectively.

Figure 6:
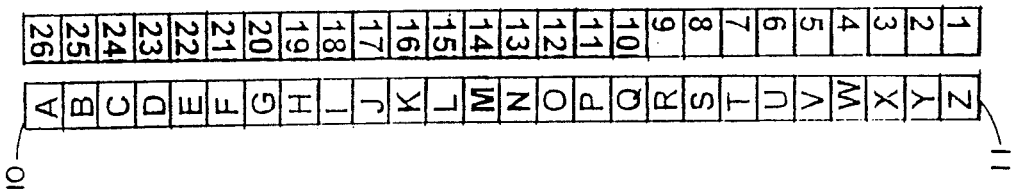
FIG. 6 discloses still another combination of markings on the front and back sides of the tabs.
Figure 5:
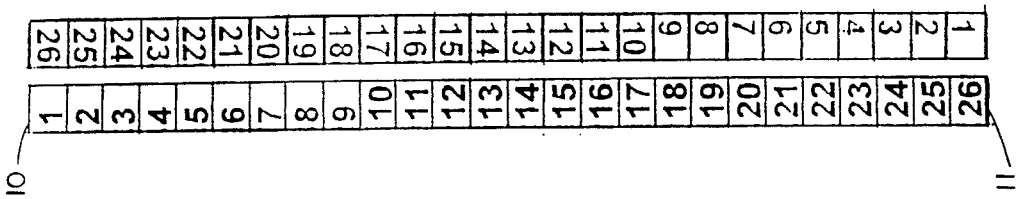
FIG. 5 shows another combination of markings on the front and back sides of tabs for another series of dividers.
Figure 4:
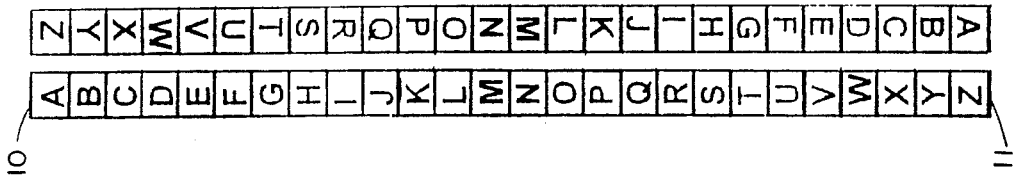
FIG. 4 discloses the markings of tabs on the front and on the back sides of a series of dividers.

Referring to FIGS. 4, 5, and 6, they disclose three different combinations for a series of dividers and FIG. 4 discloses letters on each side of the tabs as illustrated by FIGS. 1, 2, and 3. FIG. 5 shows numbers on each side of the tabs and FIG. 6 shows a number on one side of the tab and numbers on the other sides of the tabs. Any of these three different combinations of indicia can be utilized in accordance with this invention as well as any other indicia that might be devised utilizing the concept of my invention.

OPERATION

Having disclosed my invention, the operation is quite simple. For example, in the use of the series as disclosed in FIGS. 1, 2, and 3, if only the dividers marked A through H are utilized, it is not necessary to dispose of the other dividers marked I through Z. These dividers can be utilized as indexing dividers for A through R by simply turning the dividers over with the edge 11 on top and the edge 10 on the bottom. Should all of the dividers A through Z be utilized and either the sheets marked on or the letters mutilated, the dividers can also be utilized by turning them upside down with the edge 11 of each divider and the edge 10 of each divider on the bottom. Thus, this invention provides a tremendous savings in paper with very little cost incurred by printing the tabs on both sides.

Having described my invention, it should become obvious that although I have disclosed the preferred embodiment thereof, many changes and modifications may be to the embodiments portrayed herein without departing with the spirit and scope of the invention.

The embodiments of the invention in which an exclusive property or privilege is claimed are defined as follows:

1. A manuscript divider system for use in dividing and indexing a manuscript into a series of predetermined, sequential indicia starting with a low indicia and ending with a high indicia comprising:

a plurality of superimposed sheets of material of a predetermined number making up said series, said series of sheets including a first sheet and a last sheet with intermediate sheets therebetween, each sheet having a tab extending from one edge; said one edge of said sheets being aligned and said tabs being offset vertically one from the other from the first sheet to the last sheet so as to display the indicia marked on each tab;

said tab of said first sheet having marked on its front side the lowest indicia and on its back side the highest indicia, said highest indicia being rotated 180° with respect to said lowest indicia;

said tab of said last sheet having marked on its front side the highest indicia and on its back side the lowest indicia, said lowest indicia being rotated 180° with respect to the highest indicia;

said tabs of said intermediate sheets from the second sheet to the penultimate sheet each having marked on its front side a progressively higher indicia following the low indicia of said tab of said first sheet to the high indicia of said tab of said last sheet; and said tabs of said intermediate sheets from second to the penultimate each having marked seriatim on its back side a progressively lower indicia starting with the second highest indicia of said last sheet and progressively reducing to the second lowest indicia.

2. The divider system of claim 1 in which the indicia on both sides of said tabs are numbers.

3. The divider system of claim 1 in which the indicia on both sides of said tabs are letters.

4. The divider system of claim 1 in which the indicia on one side of said tabs are numbers and the tabs on the other side of the tabs are letters.

* * * * *